US006563394B1

(12) United States Patent
Kudo

(10) Patent No.: US 6,563,394 B1
(45) Date of Patent: May 13, 2003

(54) COAXIAL CIRCULATOR WITH COPLANAR Y-SHAPED CONDUCTOR AND GROUND PATTERNS

(75) Inventor: Kenichi Kudo, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/625,097

(22) Filed: Jul. 25, 2000

(30) Foreign Application Priority Data

Jul. 27, 1999 (JP) ..... 11-212841

(51) Int. Cl.[7] ..... H01P 1/387
(52) U.S. Cl. ..... 333/1.1; 333/24.2
(58) Field of Search ..... 333/24.2, 1.1

(56) References Cited

U.S. PATENT DOCUMENTS 3,573,666 A * 4/1971 Caffrey et al. ..... 333/1.1

FOREIGN PATENT DOCUMENTS

JP 62-258503 * 11/1987 ..... 333/1.1
JP 6-97706 4/1994
JP 6-268414 9/1994

* cited by examiner

*Primary Examiner*—Justin P. Bettendorf
(74) *Attorney, Agent, or Firm*—Katten Muchin Zavis Rosenman

(57) ABSTRACT

A coaxial circulator having ferrite members to which a static magnetic field is applied at a junction of a Y-shaped strip conductor, the coaxial conductor including a dielectric substrate, an inner pattern of the Y-shaped strip conductor provided on a center of an upper surface of the dielectric substrate, and ground patterns provided on the upper surface and a lower surface of the dielectric substrate along a periphery of the conductive inner pattern and electrically connected to each other via a plurality of through-holes in the dielectric substrate, the substrate being sandwiched by an upper block and a lower block, the ferrite members being provided adjacent to both the upper side and a lower side of the substrate so as to ground the ground patterns to the upper and lower block surfaces.

6 Claims, 19 Drawing Sheets

FIG. 2A
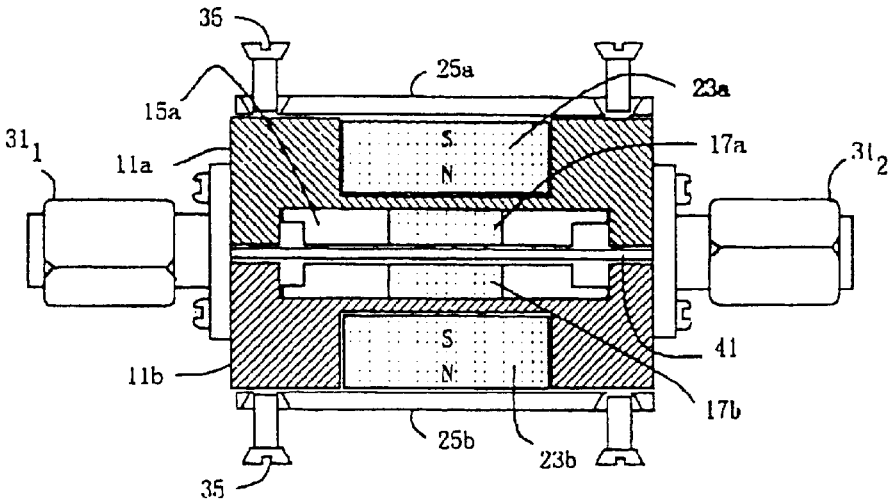
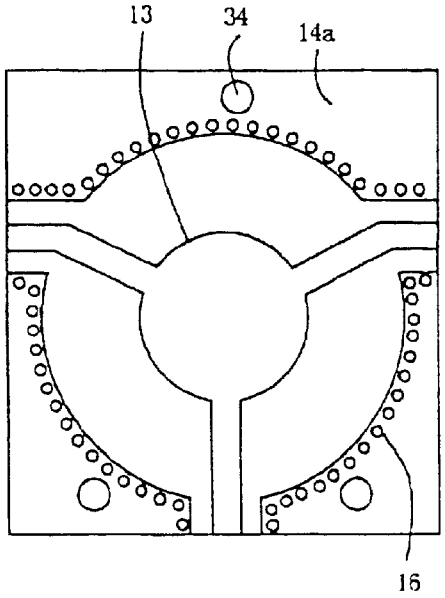
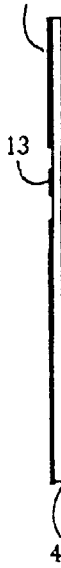
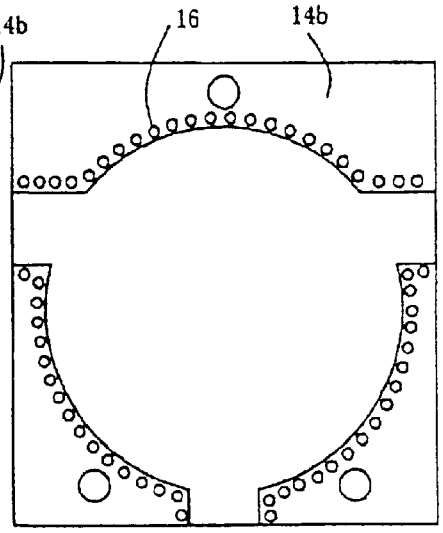
FIG. 2B FIG. 2C FIG. 2D

FIG. 4A
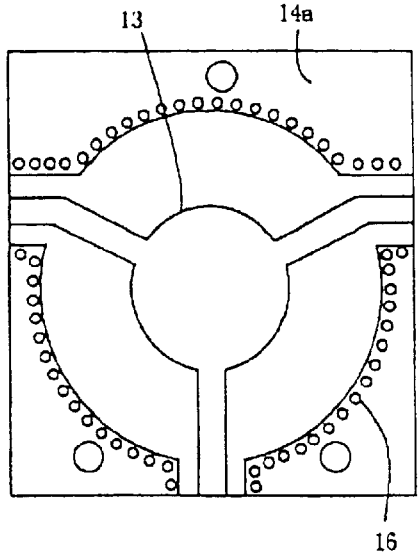
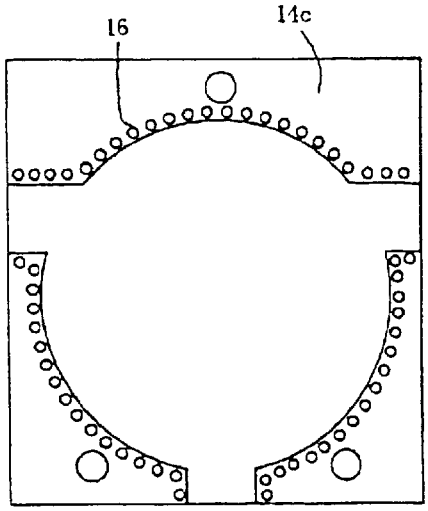
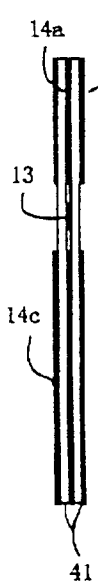
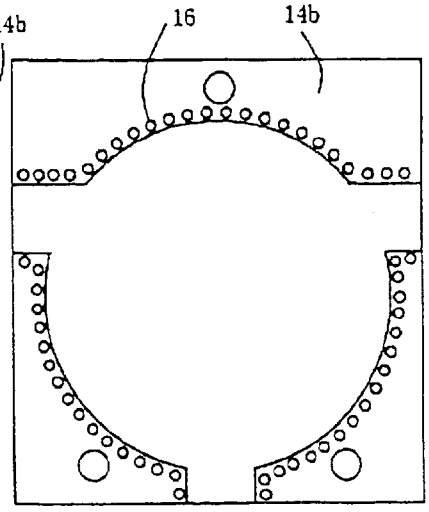
FIG. 4B FIG. 4C FIG. 4D

COAXIAL CIRCULATOR WITH COPLANAR Y-SHAPED CONDUCTOR AND GROUND PATTERNS

BACKGROUND OF THE INVENTION

1. Field of the Invention

The present invention relates generally to a coaxial circulator and an element sharing device, and more particularly, to a coaxial circulator constructed so that a ferrite member to which a static magnetic field is applied is positioned at a junction of a Y-shaped strip conductor and an element sharing device using such a circulator.

2. Description of the Related Art

Conventionally, an element sharing device used in a wave decoupling device of a multiplex radio communications apparatus, such as an antenna sharing device, is formed from a waveguide component. In recent years, however, as devices have become cheaper and more compact, there is a growing need to make the element sharing device a coaxial component.

However, in an element sharing device, in which multiple. transmission frequencies pass through the same point, it is known that harmonic distortion ($2f_2-f_1$, $f_1+f_2-f_3$) arises due to arbitrary two waves or three waves of the transmission frequency, and that, if this harmonic distortion enters the reception frequency band, the true reception signal is degraded. Normally, an isolation function of the circulator used on the element sharing device drops the harmonic distortion arising on the transmitting side to a level below which reception is no longer affected. However, harmonic distortion generated inside the element sharing device is transmitted as is to the reception side, creating many problems. Accordingly, it is desirable that no harmonic distortion be generated inside the element sharing device.

FIGS. 16, 17A, 17B, 18, 19A and 19B are diagrams illustrating the conventional art. FIG. 16 is a diagram showing an expanded view of a conventional coaxial circulator. As shown in the diagram, coaxial connectors $\mathbf{31}_1$ through $\mathbf{31}_3$ are mounted at three openings in the sides of a metal block 11 and a Y-shaped inner conductor 13 (having a circular junction at a center thereof) is fixedly mounted by soldering between the three central conductors $\mathbf{31}_1$ through $\mathbf{31}_3$. On a top side of the inner conductor 13 are mounted, in order, a polytetrafluoroethylene support 15*a* and a ferrite member 17*a* whose position is determined by the polytetrafluoroethylene support 15*a,* a copper disc 19*a,* an aluminum ring 21*a* and a magnet 23*a* whose position is determined by the aluminum ring 21*a,* on top of which a yoke 25*a* is mounted and attached to the block 11 by using a screw. The bottom side of the inner conductor 13 is configured similarly.

FIGS. 17A and 17B are second diagrams illustrating the conventional art. FIG. 17A is a plan view of the inner conductor 13 and FIG. 17B is a cross-sectional view of an assembled coaxial circulator along the line a—a of FIG. 17A.

It should be noted that, in order to prevent the occurrence of harmonic distortion in a coaxial circulator of this type, the copper discs 19*a,* 19*b* that contact the ferrite members 17*a,* 17*b* must be securely electrically grounded.

FIG. 18 is a third diagram illustrating the conventional art, and more specifically, shows an expanded view of an upper right portion of FIG. 17B. Conventionally, ring 21*a* is thickened, so that when a screw 35 is tightened to a screw hole 33 in the block 11, the yoke 25*a* urges the ring 21*a* downward, pressing the copper disc 19*a* against an inner stepped portion of the block 11 so that the copper disc 19*a* is grounded. The copper disc 19*b* is similarly grounded.

However, the problem with the above-described arrangement is that the seating of the copper discs 19*a* and 19*b* against the block 11 becomes partially inadequate if the parts on the inside of the copper discs 19*a,* 19*b,* (that is, the ferrite members 17*a,* 17*b,* the polytetrafluoroethylene supports 15*a,* 15*b,* and so on) are not shaped exactly to the correct dimensions, and this inadequate or incomplete contact generates harmonic distortion.

FIGS. 19A and 19B are fourth diagrams illustrating the conventional art. FIG. 19A, for example is a diagram showing output characteristics in the event that harmonic distortion (two-wave and three-wave distortion) is generated.

It should be noted that it has been confirmed that the state of the grounding of the copper discs 19*a* and 19*b* to the stepped portion of the block 11 can be improved by inserting copper foil thereinbetween, thus making it possible to improve the output characteristics. FIG. 19*b* shows such improved output characteristic.

However, insertion of the copper foil is an unsatisfactory solution to the above-described drawback because it complicates the structure of the device.

SUMMARY OF THE INVENTION

Accordingly, it is a general object of the present invention to provide an improved and useful coaxial circulator and element sharing device in which the above-described disadvantages are eliminated.

Another and further object of the present invention is to provide an improved and useful coaxial circulator and element sharing device having a simple structure that adequately suppresses harmonic distortion.

The above-described objects of the present invention are achieved by a coaxial circulator having ferrite members to which a static magnetic field is applied disposed at a junction of a Y-shaped strip conductor, the coaxial conductor comprising:

a dielectric substrate;

an inner pattern of the Y-shaped strip conductor provided on a center of an upper surface of the dielectric substrate; and ground patterns provided on the upper surface and a lower surface of the dielectric substrate along a periphery of the conductive inner pattern and electrically connected to each other via a plurality of through-holes in the dielectric substrate, the substrate being sandwiched by an upper block and a lower block, the ferrite members being provided adjacent to both the upper side and a lower side of the substrate so as to ground the ground patterns to the upper and lower block surfaces.

According to the invention described above, by providing a,conductive inner pattern on top of the dielectric substrate, together with the peripheral ground patterns a variety of waveguide structures (that is, characteristics) can be achieved. Additionally, changes to the conductive inner pattern can be easily added, thus making it possible to provide a coaxial circulator with the desired characteristics without regard for variations in the characteristics of peripheral components. Additionally, the ground patterns of the dielectric substrate are sandwiched by the ground faces of the blocks together with the upper and lower ferrite members the bringing together of which makes it possible to obtain a full and complete ground plane of the waveguides (specifically, the upper and lower edge surfaces of the ferrite members on the periphery of the conductive inner pattern.

The above-described objects of the present invention are also achieved by device comprising:

a single dielectric substrate having dielectric substrate portions of a plurality of coaxial circulators, a Y-shaped conductive inner pattern provided on a center of an upper surface of each one of the dielectric substrate portions, ground patterns provided on the upper surface and a lower surface of each of the dielectric substrate portions and electrically connected to each other via a plurality of through-holes formed in each of the dielectric substrate portions along a periphery of the conductive inner pattern, each of the dielectric substrate portions being sandwiched by an upper block and a lower block, ferrite members being provided adjacent to both the upper side and the lower side of each of the dielectric substrate portions so as to ground the ground patterns to the surfaces of the upper and lower block; and the plurality of coaxial circulators directly coupled to each other via the single dielectric substrate.

According to the invention described above, by directly coupling a plurality of coaxial circulators via a single dielectric substrate structure, the harmonic distortion generated at the conventional connecting portions can be adequately suppressed.

The above-described objects of the present invention are also achieved by a coaxial circulator having ferrite members to which a static magnetic field is applied disposed at a junction of a Y-shaped strip conductor, the coaxial circulator comprising:

an intermediate block containing a central conductor and the ferrite members provided at top and bottom sides of the central conductor; and an upper block and a lower block, surfaces of the upper block and the lower block contacting upper and lower surfaces of the intermediate block, respectively.

The above-described objects of the present invention are also achieved by a coaxial circulator having ferrite members to which a static magnetic field is applied disposed at a junction of a Y-shaped strip conductor, the coaxial circulator comprising:

an upper block and a lower block;

a central conductor positioned between the upper block and lower block; and a supporting member positioning the ferrite members within an interior space formed by the upper block and the lower block.

According to the invention described above, a secure ground plane can be obtained within the waveguide space of the circulator using a simple structure, so the internal generation of harmonic distortion can be adequately suppressed.

Other objects, features and advantages of the present invention will become more apparent from the following detailed description when read in conjunction with the accompanying drawings.

BRIEF DESCRIPTION OF THE DRAWINGS

FIGS. 2A, 2B, 2C and 2D are cross-sectional views of the coaxial circulator according to a first embodiment of the present invention and front, side and back surfaces of a dielectric substrate of the coaxial circulator according to a first embodiment of the present invention, accordingly;

FIGS. 4A, 4B, 4C and 4D are first diagrams illustrating a variation of the first embodiment of the present invention;

DESCRIPTION OF THE PREFERRED EMBODIMENTS

A description will now be given of embodiments of the present invention, with reference to the accompanying drawings. It should be noted that identical reference numbers denote identical or corresponding elements in all drawings.

Figure 1:
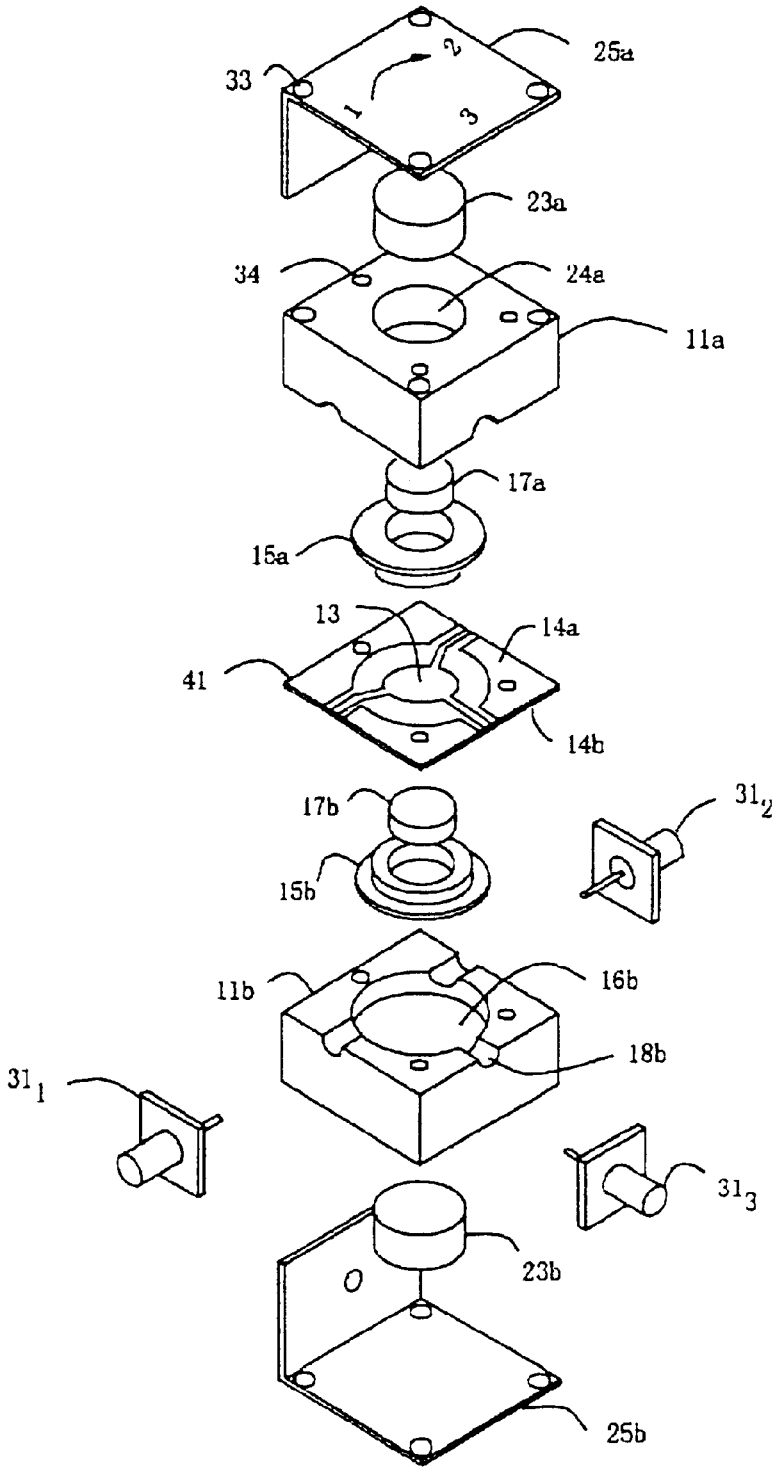
FIG. 1 is a first diagram of a coaxial circulator according to a first embodiment of the present invention.

FIG. 1 is a first diagram of a coaxial circulator according to a first embodiment of the present invention. FIGS. 2A, 2B, 2C, 2D and 3 illustrate the coaxial circulator according to the first embodiment of the present invention.

FIG. 1 shows an exploded view of the coaxial circulator. As shown in the diagram, the coaxial circulator sandwiches a central dielectric substrate 41 together with upper and lower ferrite members 17*a*, 17*b* between upper and lower blocks 11*a*, 11*b*, the whole assembly being held together by the fastening of three screws using three screw holes 34, thus obtaining a secure ground plane at a periphery of a conductive inner pattern 13.

FIG. 2A is a diagram showing a cross-sectional view of a fully assembled circulator. An upper block 11*a* has countersunk holes, or concave portions, in both top and bottom sides thereof, the top concavity directly containing a magnet 23*a* and the bottom concavity containing polytetrafluoroethylene support 15*a* and a ferrite member 17*a,* the position of the ferrite member 17*a* being determined by the polytetrafluoroethylene supports 15*a*. In this state, a top surface of the ferrite member 17*a* securely contacts a ground plane (the floor of the concave portion) of the upper block 11*a,* as a result of which no harmonic distortion is generated. The lower block 11*b* is similarly structured.

FIGS. 2B, 2C and 2D show front, side and back surfaces, respectively, of the dielectric substrate 41. The front surface of the dielectric substrate 41 is provided with a Y-shaped conductive inner pattern 13 and a ground pattern 14*a* on a periphery of the conductive inner pattern 13 so as to surround the conductive inner pattern 13, the ground pattern 14*a* having the same shape as that of the inner diameter of the upper block 11*a*. Additionally, the back surface of the dielectric substrate 41 has the same ground pattern 14*b* as that on the front surface of the dielectric substrate 41, with both ground patterns 14*a,* 14*b* being electrically shorted, that is, coupled to each other by multiple through-holes 16 positioned as near as possible to the conductive inner pattern 13.

In the above-described structure, the conductive inner pattern 13 is stably supported by the dielectric substrate 41. Additionally, a secure ground plane is formed at the peripheral surface of the conductive inner pattern 13 by the ground patterns 14*a,* 14*b* and the through-holes 16, essentially as if the conductive inner pattern 13 were to be surrounded by an extension of the upper block 11*a*. The back surface of the dielectric substrate 41 is similarly electrically grounded.

Figure 3A:
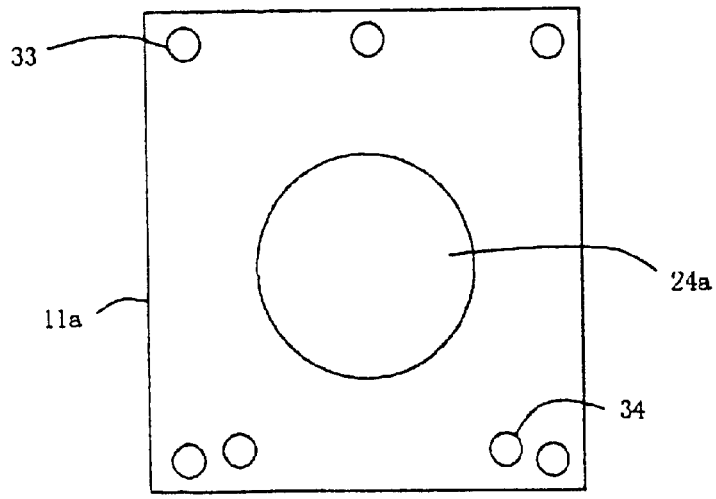
FIGS. 3A, 3B and 3C are diagrams showing top, side and bottom surfaces of an upper block of the coaxial circulator according to a first embodiment of the present invention.
Figure 3B:
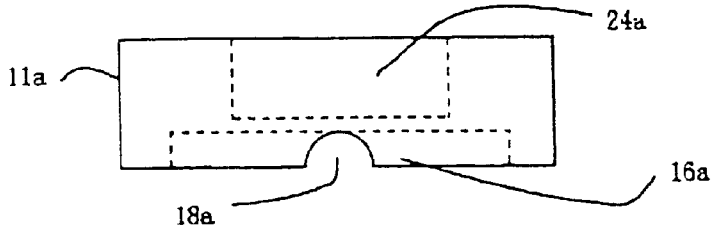
Figure 3C:
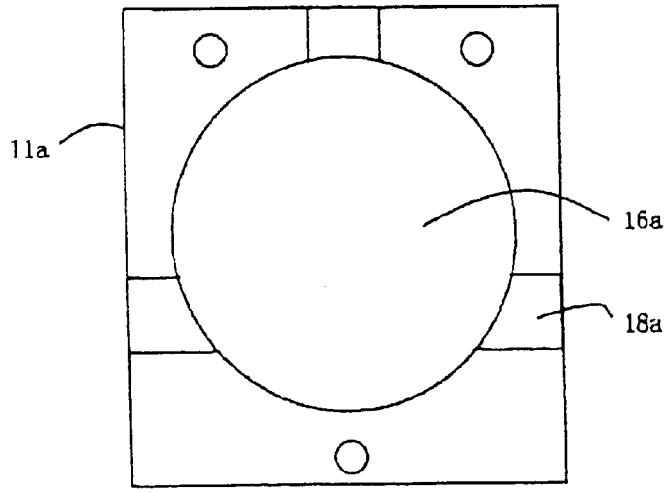

FIGS. 3A, 3B and 3C show the top, side and bottom surfaces of the upper block 11*a,* respectively.

As shown in FIG. 3A, a countersunk hole or concavity 24*a* having essentially the same size as that of a magnet 23*a* is provided in the top surface of the block 11*a,* with the magnet 23*a* being fully contained within the concavity 24*a*. Such a construction eliminates the need for the conventional aluminum ring 21*a* and thus reduces the number of component parts, thereby simplifying the structure of the circulator.

As shown in FIG. 3B, a slot portion 18*a* for the purpose of forming an opening for coupling an additional coaxial connector 31 to the lower block 11*b* is formed in the side surface of the upper block 11*a*.

As shown in FIG. 3C, the concavity 16*a* is formed in the bottom surface of the upper block 11*a,* for the purpose of containing the polytetrafluoroethylene supports 15*a* and the ferrite member 17*a* positioned at the center (circular junction) of the conductive inner pattern 13 by the polytetrafluoroethylene supports 15*a*.

Returning to FIG. 3B, it can be appreciated that the upper and lower countersunk holes 24*a* and 16*a* do not communicate with each other but are instead separated by metallic block material. This border plane contacts the top surface of the ferrite member 17*a* and at the same time forms a single unit with the upper block 11*a* so as to form a complete ground plane for the waveguide portion of the circulator. Accordingly, the conventional circular copper sheet 19*a* can be eliminated, thus reducing the number of component parts and thereby simplifying the structure of the circulator.

Returning to FIG. 3C, it can be appreciated that the countersunk hole 16*a* and the slot portion 18*a* do communicate with each other, with all other sections being flat planes, and accordingly, a secure electrical ground contact with the ground pattern 14*a* of the dielectric substrate 41 can be obtained. Lower block 11*b* is structured accordingly.

By sandwiching the dielectric substrate 41 between the upper block 11*a* and lower block 11*b* and holding the whole assembly together with screws as described above, the need for the conventional ground reinforcing component such as metallic foil and the like is eliminated because the stable ground plane is securely formed on the periphery of the conductive inner pattern 13. Additionally, an interface with external circuitry is converted into a connector at each substrate edge of the pattern extending in three directions from the circular junction of the conductive inner pattern 13.

FIGS. 4 through 10 show various variations of the first embodiment of the present invention.

FIGS. 4A, 4B, 4C and 4D show a variation of the dielectric substrate 41 shown in FIGS. 2A, 2B, 2C and 2D, in which the dielectric substrate 41 has three layers instead of two. FIGS. 4B, 4C and 4D show top, side and bottom views of the dielectric substrate 41 of the present variation. FIG. 4A shows individual patterns on the intermediate layer. In FIG. 4C, it can be appreciated that the dielectric substrate 41 has three layers. In FIG. 4A, the intermediate layer of the dielectric substrate 41 of the present variation has the conductive inner pattern 13 and the ground pattern 14*a*. FIGS. 4B and 4D show that the top surface and bottom surface each have ground patterns 14*c,* 14*b* identical to the ground pattern 14*a* of the intermediate layer. These ground patterns 14*a,* 14*b* and 14*c* are electrically shorted, that is, coupled to each other by the through-holes 16. It will be appreciated that conductive inner pattern 13 of the present variation is centrally positioned in the waveguide space formed by the upper and lower blocks 11*a,* 11*b,* thereby improving the symmetry (balance) of the waveguide structure.

Figure 5A:
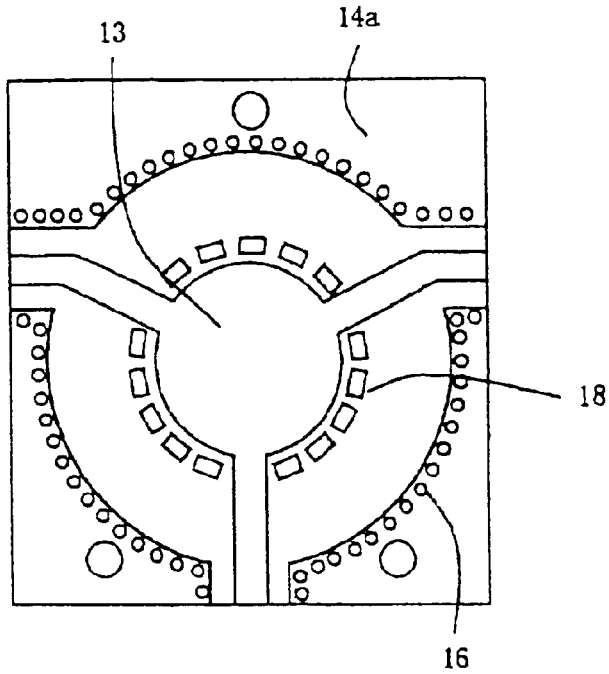
FIGS. 5A and 5B are second diagrams illustrating a variation of the first embodiment of the present invention.
Figure 5B:
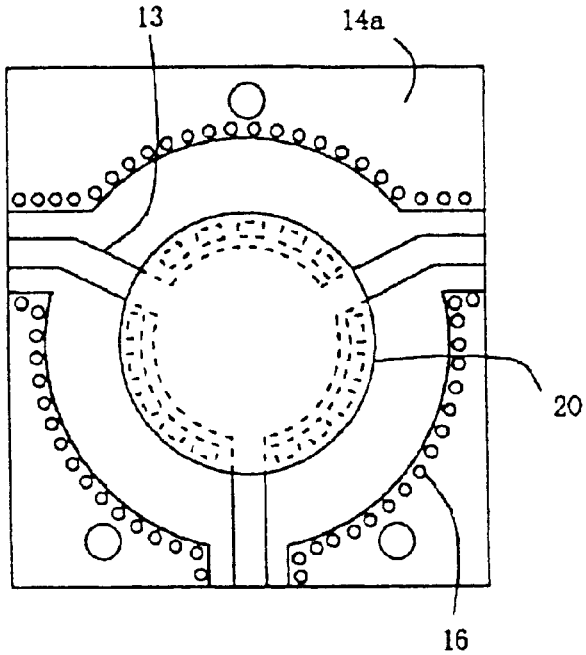

FIGS. 5A and 5B show other variations of the dielectric substrate 41 shown in FIG. 2. FIG. 5A depicts a case in which a plurality of lands 18 are provided at the periphery of the junction of the Y-shaped conductive inner pattern 13. In a coaxial circulator of this type, it is not unusual for variations in the ferrite member 17 and fluctuations in characteristic to cause the circulator characteristic to shift toward the higher frequencies.

Figure 6A:
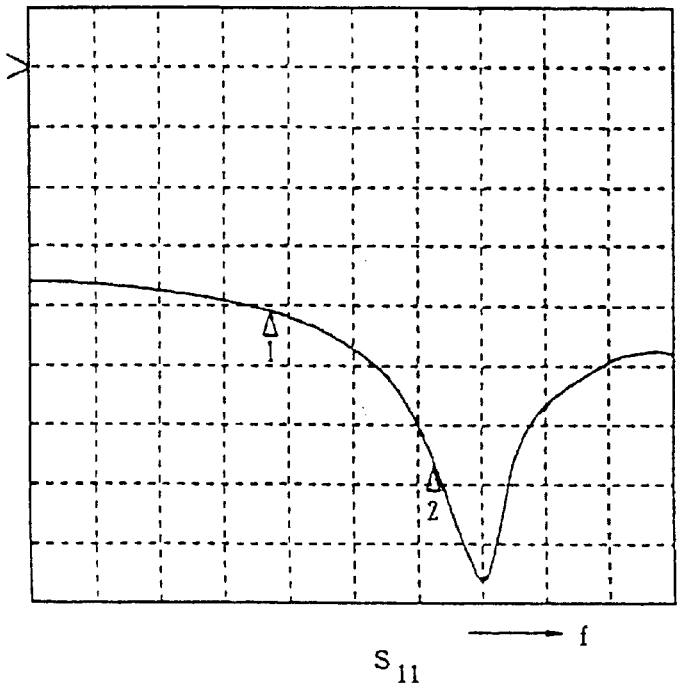
FIGS. 6A and 6B are third diagrams illustrating a variation of the first embodiment of the present invention.
Figure 6B:
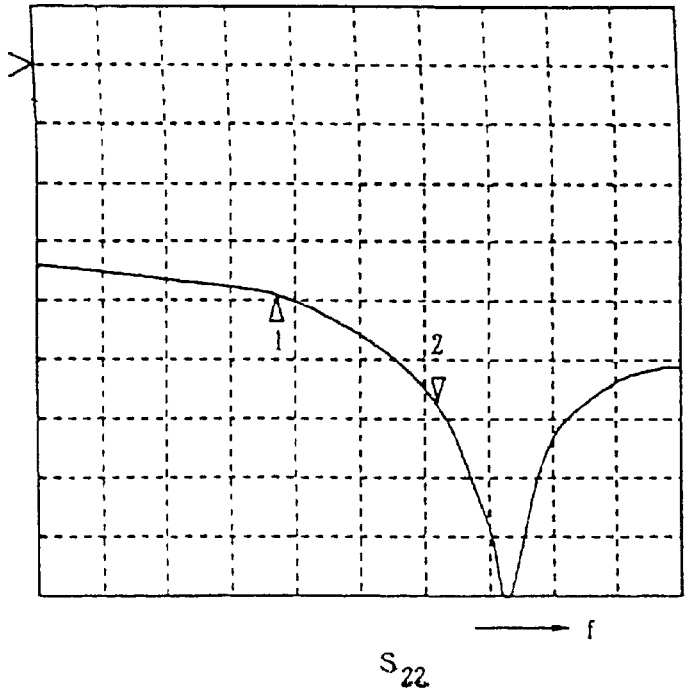

For example, FIGS. 6A and 6B show return loss for this type of coaxial circulator. FIG. 6A shows a terminal 1 return loss $S_{11}$, with the required frequency band range indicated by markers Δ1,Δ2. In this case, the return loss minimum point is shifted slightly toward the higher frequencies. FIG. 6B shows a terminal 2 return loss $S_{22}$, likewise with the required frequency band range indicated by markers Δ1,Δ2. In this case, the return loss minimum point is shifted slightly toward the higher frequencies.

In such cases as described above, as shown in FIG. 5B an enlarged circular copper foil sheet 20 is prepared and soldered to the conductive inner pattern 13 using a multiplicity of lands 18. The circular copper foil sheet 20 is soldered at a certain height above the conductive inner pattern 13 due to the presence of the lands 18, so a uniform contact can be obtained with the ferrite member 17*a* as well. In so doing the junction diameter increases and the resonance frequency of the ferrite. member 17*a* decreases, so adjustment to the necessary frequency band can be made without a major change in the component parts.

Figure 7A:
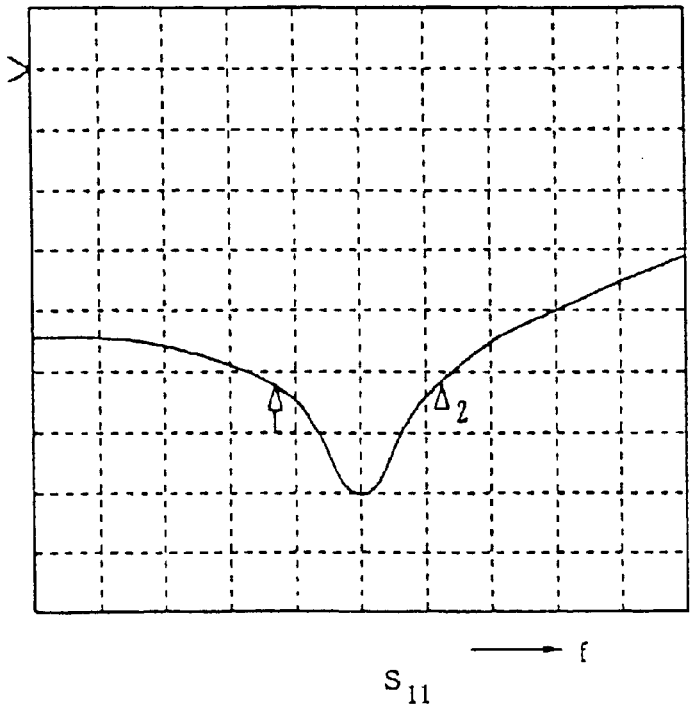
FIGS. 7A and 7B are fourth diagrams illustrating a variation of the first embodiment of the present invention.
Figure 7B:
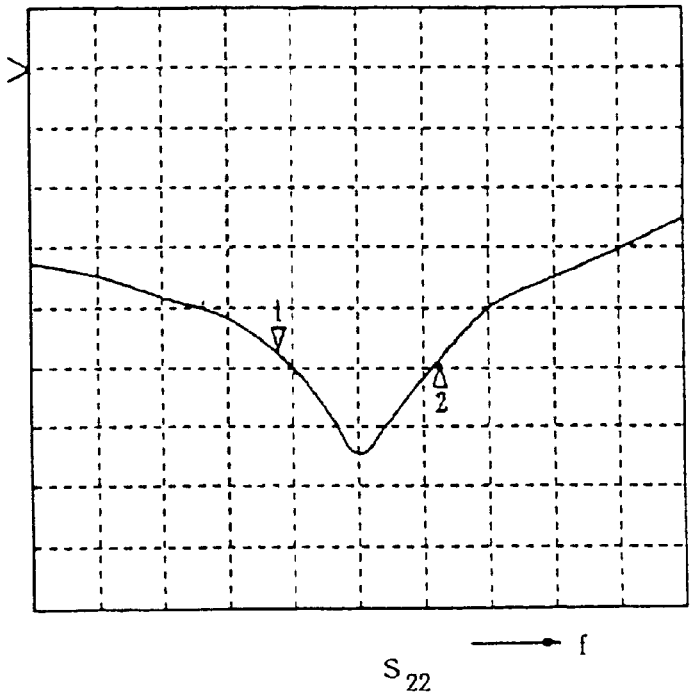

FIGS. 7A and 7B show return loss after adjustment as described above. FIG. 7A shows a terminal 1 return loss $S_{11}$, with the return loss minimum point shifted to within the required frequency band range indicated by markers Δ1,Δ2. FIG. 7B shows a terminal 2 return loss $S_{22}$, likewise with the return loss minimum point shifted to within the required frequency band spanning markers Δ1, Δ2.

Figure 8A:
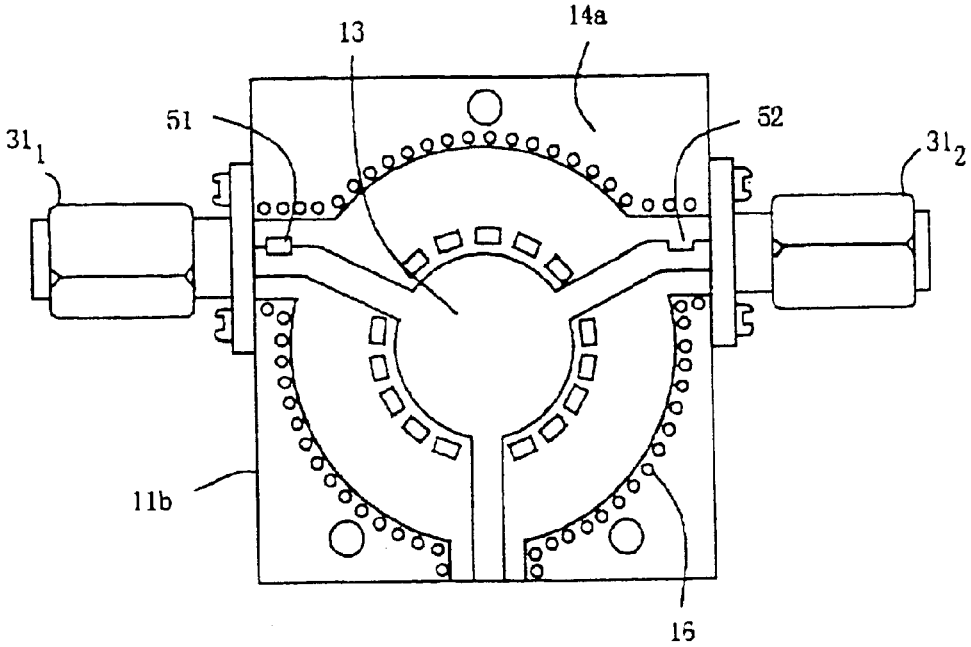
FIGS. 8A and 8B are fifth diagrams illustrating a variation of the first embodiment of the present invention.
Figure 8B:
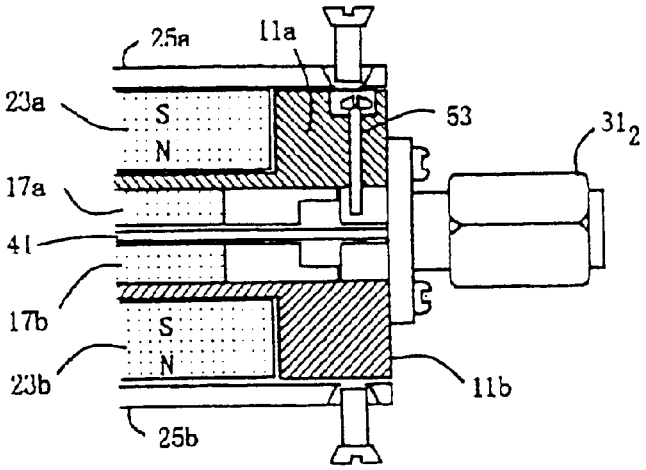

Further, as shown in FIGS. 8A and 8B, it is relatively easy to perform a variety of processes to the conductive inner pattern 13 on the dielectric substrate 41. For example, as shown in FIG. 8A, copper foil 51 may be soldered to or a notch 52 may be cut in the conductive inner pattern 13, by which means the input/output impedance can be easily changed. Preferably, as shown in FIG. 8B, by inserting a screw 53 from the upper block 11*a* into the pattern portion to be used in place of the coaxial circulator 31 within the conductive inner pattern 13, it is possible to adjust the input/output impedance simply by changing the depth to which the screw is inserted. Additionally, the accuracy of the pattern of the inner conductor can be rough, with final adjustment thereof easily accomplished with the circulator in a fully assembled state without shaving the pattern of the inner conductor or adjusting the foil.

Figure 9A:
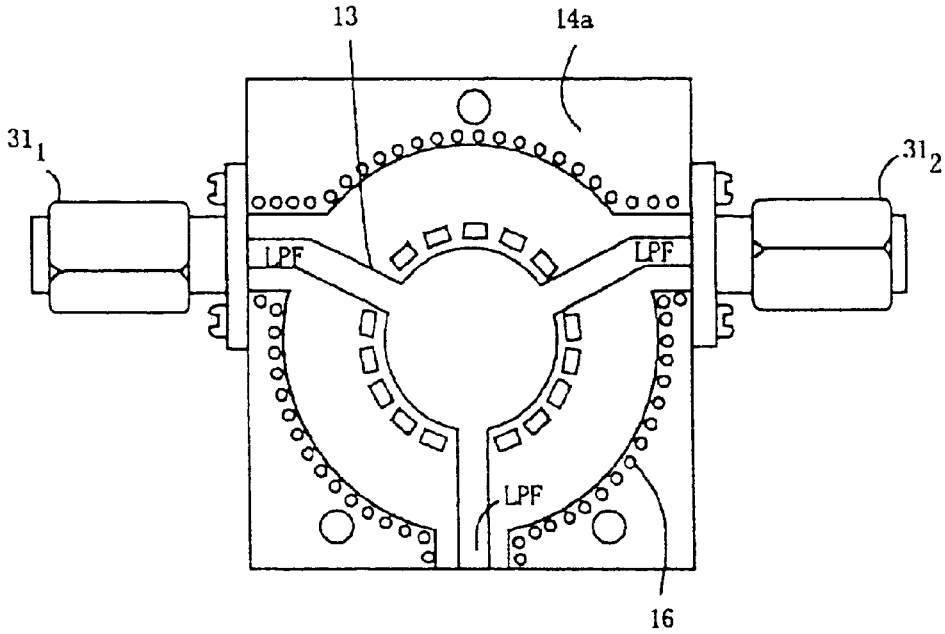
FIGS. 9A and 9B are sixth diagrams illustrating a variation of the first embodiment of the present invention.
Figure 9B:
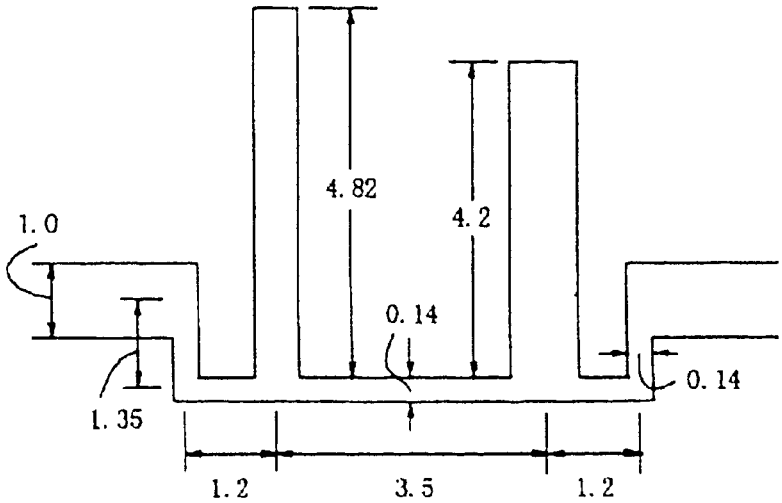

Additionally, as shown in FIGS. 9A and 9B, it is easy to form complex patterns such as a LPF with respect to the conductive inner pattern 13 on the dielectric substrate 41. FIG. 9B shows one such LPF together with its dimensions. In this case, the printed circuit board material is a polytetrafluoroethylene-glass substrate having a thickness of 0.4 mm, the filter pass band being 3.6 GHz–4.2 GHz, the cut-off frequency being 5 GHz, the number of steps being five.

Figure 10:
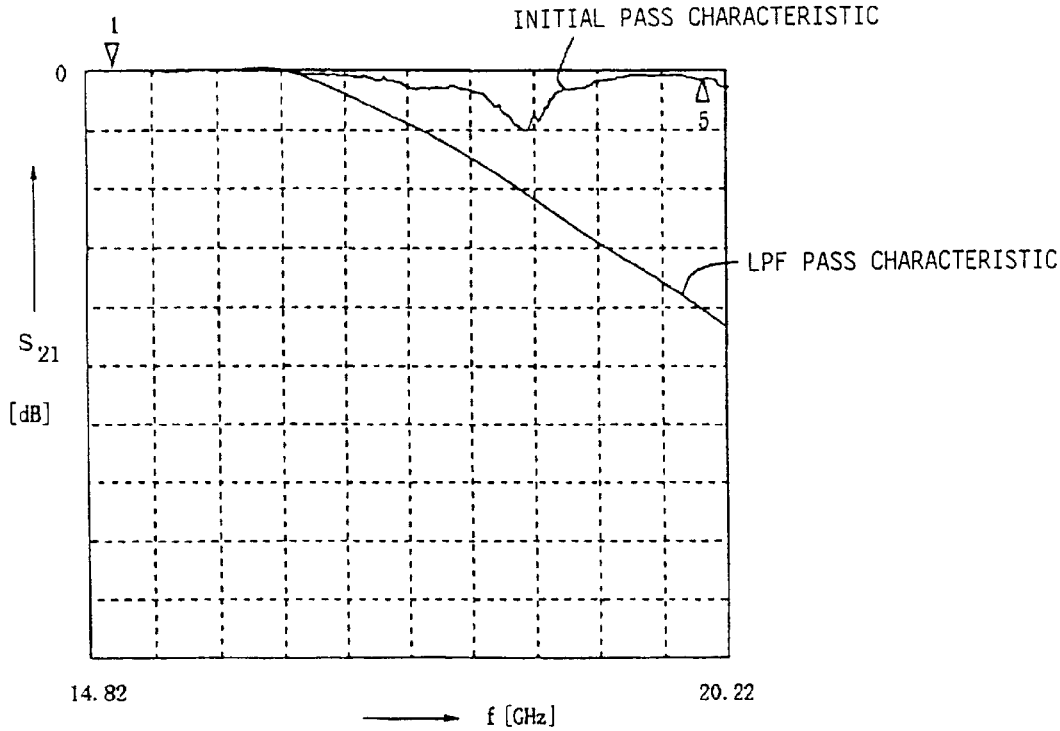
FIG. 10 is a seventh diagram illustrating a variation of the first embodiment of the present invention.

FIG. 10 shows LPF pass characteristic, the horizontal axis representing frequency and the vertical axis representing pass characteristic $S_{21}$. If the range indicated by the markers Δ1,Δ1 is the circulator required band, then, as can be appreciated, in a case in which no LPF is provided the initial pass extends well beyond the required band into the higher frequencies. As a result, if a high-power signal such as a radar signal is present at or near marker Δ5, then a low-noise amplifier (LNA) on the reception side can become saturated by this unwanted signal. By providing an LPF on the circulator, passage of the unneeded wave can be adequately suppressed.

Figure 11:
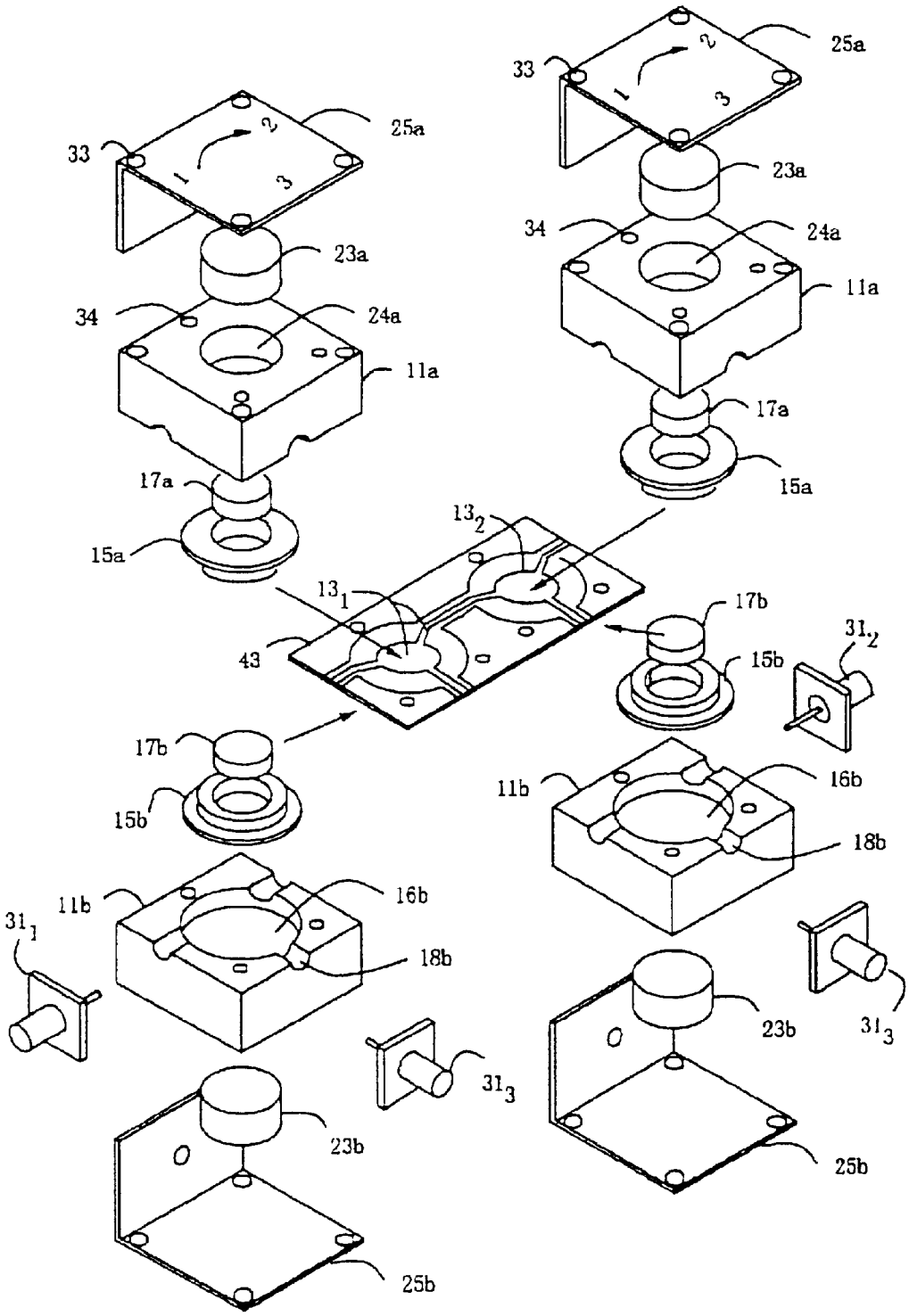
FIG. 11 is a diagram illustrating an element sharing device according to the first embodiment of the present invention.

FIG. 11 is a diagram illustrating an element sharing device according to the first embodiment of the present invention, in which the element sharing device is shown in an exploded or disassembled state. A state in which the element sharing device is fully assembled is not shown but can be easily understood by those skilled in the art.

Basically, the element sharing device shown in the diagram comprises a plurality of coaxial circulators according to the first embodiment of the present invention as described above, the plurality of coaxial circulators being directly coupled to each other. However, unlike the conventional art, in which the circulators are simply directly coupled by a coaxial connector, the present invention uses a plurality of dielectric substrates 41 according to the first embodiment of the present invention as described above, the plurality of dielectric substrates.41 being directly coupled to each other to form a single dielectric substrate structure 43, via which single dielectric substrate 43 a plurality of coaxial circulators are directly coupled to form a single element sharing device.

That is, a terminal 2 side of the conductive inner pattern $\mathbf{13}_1$ and a terminal 1 side of the conductive inner pattern $\mathbf{13}_2$ are directly coupled to each other on the single dielectric substrate 43 as shown in the diagram, around the periphery of which a variety of component parts are assembled in the same manner as with the first embodiment of the present invention described above taking the conductive inner patterns $\mathbf{13}_1$ and $\mathbf{13}_2$ as a reference. At this time there is no gap in the direct coupling between the two circulators and a complete waveguide coupling is formed on the single dielectric substrate 43, as a result of which the kind of harmonic distortion that is generated with the conventional connector coupling can be effectively suppressed.

Additionally, it is also possible to directly couple not only two but also three or more conductive inner patterns 13, thus making it possible to form a high-performance element sharing device having .an arbitrary number of sub-units. In this case also, the finished product is economical because the individual component parts of the coaxial circulator can be used as is. Additionally, any necessary adjustments can be carried out independently at each sub-unit stage. Accordingly, it becomes possible to provide a coaxial element sharing device having as many sub-units as desired, without worrying about the harmonic distortion that is generated with the conventional connector coupling.

Additionally, by utilizing the LPF having the structure described above it becomes possible to eliminate unnecessary outside high-frequency wave components, and thus it becomes possible to effectively prevent the saturation of the LNA on the receiver side by such unneeded high-frequency components.

It should be noted that, with respect to components other than the single dielectric substrate 43, although, as noted previously, it is possible to use the individual component parts of the coaxial circulator as is when directly coupling a plurality of coaxial circulators as described above, nevertheless the as-is use of component parts is not limited solely to those of the coaxial circulator. For example, two and even three upper blocks 11*a* and lower blocks 11*b* can be combined into single block units. By so doing, both mechanical strength and electrical grounding are improved.

Figure 12:
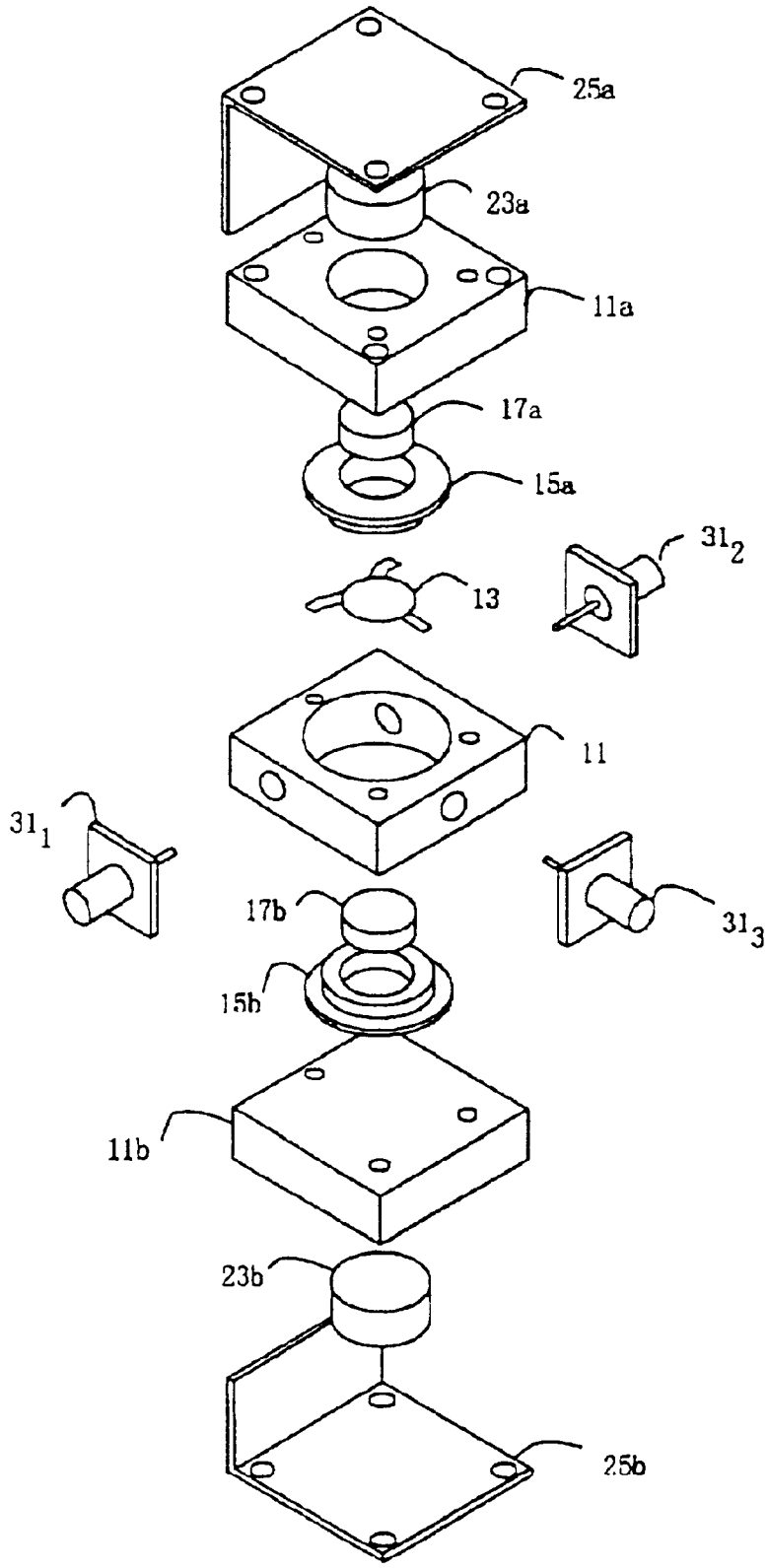
FIG. 12 is a first diagram illustrating a coaxial circulator according to a second embodiment of the present invention.
Figure 13:
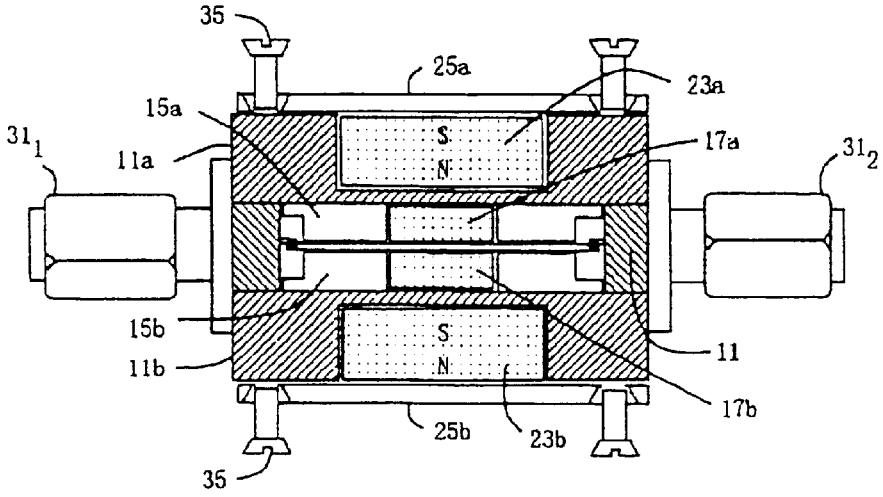
FIG. 13 is a second diagram illustrating a coaxial circulator according to the second embodiment of the present invention.

FIGS. 12 and 13 are first and second diagrams of a device using coaxial circulators an element sharing device according to a second embodiment of the present invention, showing another structure by which a secure ground plane within the circulator waveguide space can be obtained. FIG. 12 shows an exploded or disassembled view of the coaxial circulator, with coaxial connectors $\mathbf{31}_1$, $\mathbf{31}_2$ and $\mathbf{31}_3$ mounted at side openings in each of three sides of an intermediate block 11, the Y-shaped conductive inner pattern 13 being soldered between central conductors of each of the three coaxial connectors $\mathbf{31}_1$, $\mathbf{31}_2$ and $\mathbf{31}_3$. Further, upper and lower polytetrafluoroethylene supporters 15*a,* 15*b* and upper and lower ferrite members 17*a,* 17*b,* respectively, are contained above and below the conductive inner pattern 13. A bottom surface of the upper block 11*a* is a flat plane which covers an upper surface of the intermediate block 11. Additionally and similarly, a top surface of the lower block 11*b* is a flat plane which pushes against a bottom surface of the intermediate block 11. By then fastening these three blocks 11, 11*a* and 11*b* together with screws a secure ground plane can be obtained within a waveguide space of the circulator FIG. 13 shows a cross-sectional view of one such above-described fully assembled coaxial circulator.

Figure 14:
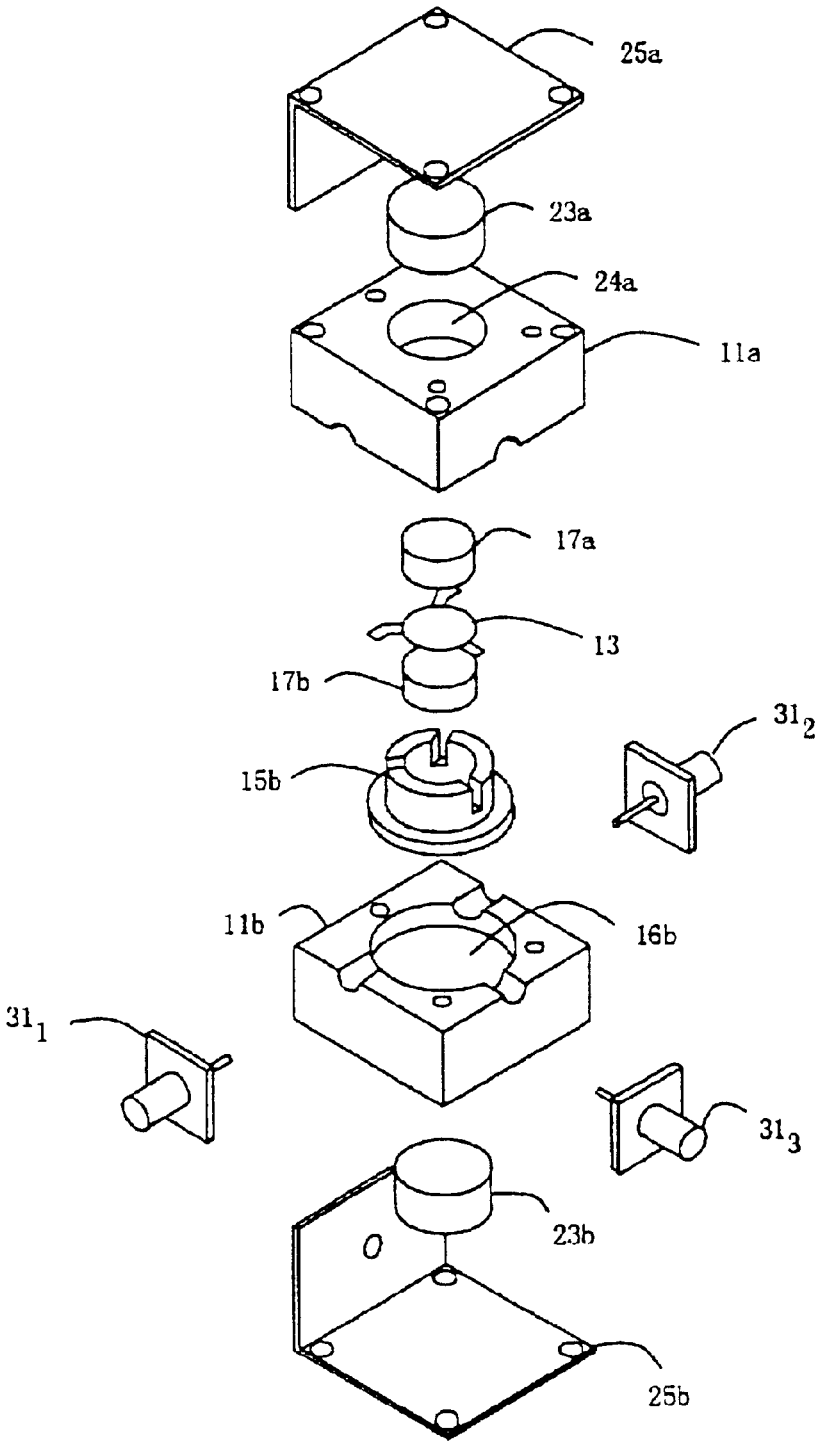
FIG. 14 is a first diagram illustrating a coaxial circulator according to the third embodiment of the present invention.
Figure 15:
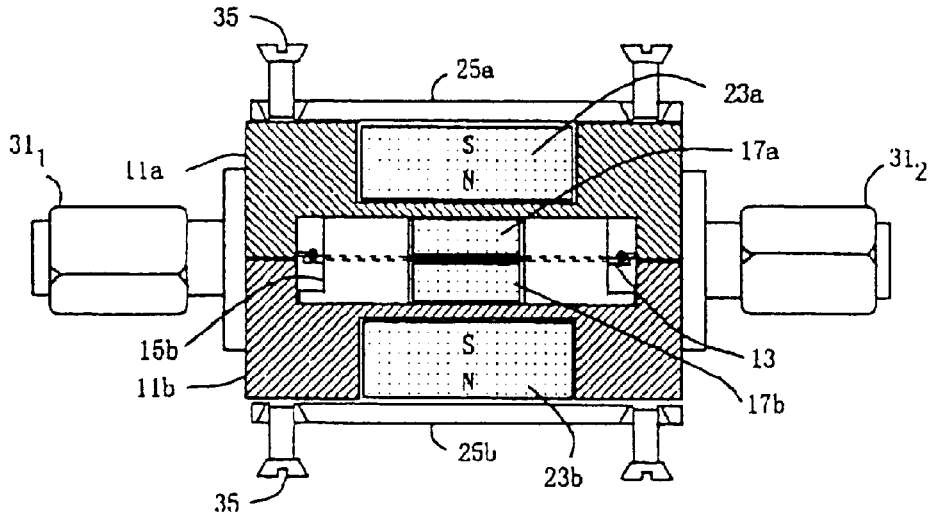
FIG. 15 is a second diagram illustrating a coaxial circulator according to the third embodiment of the present invention.
Figure 16:
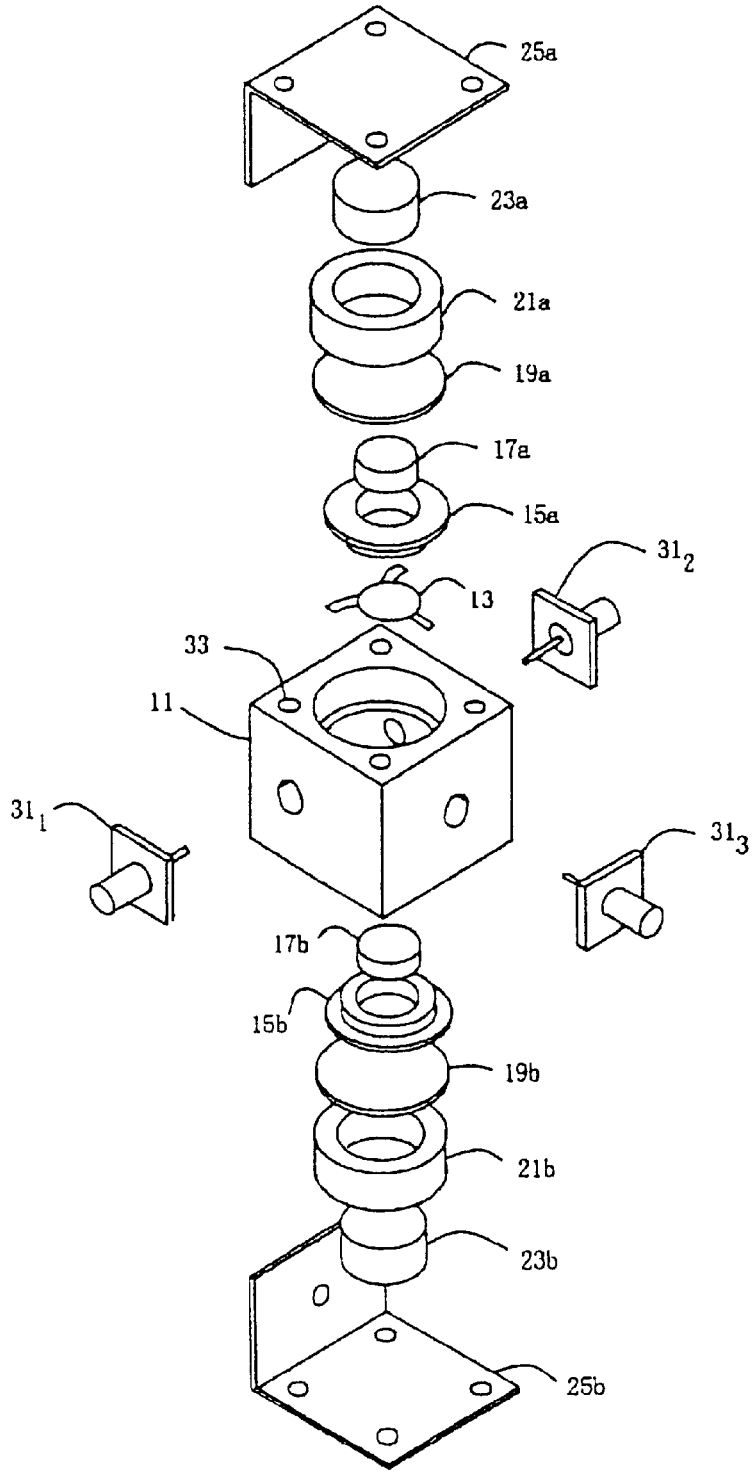
FIG. 16 PRIOR ART
FIG. 16 is a first diagram illustrating the conventional art.
Figure 17A:
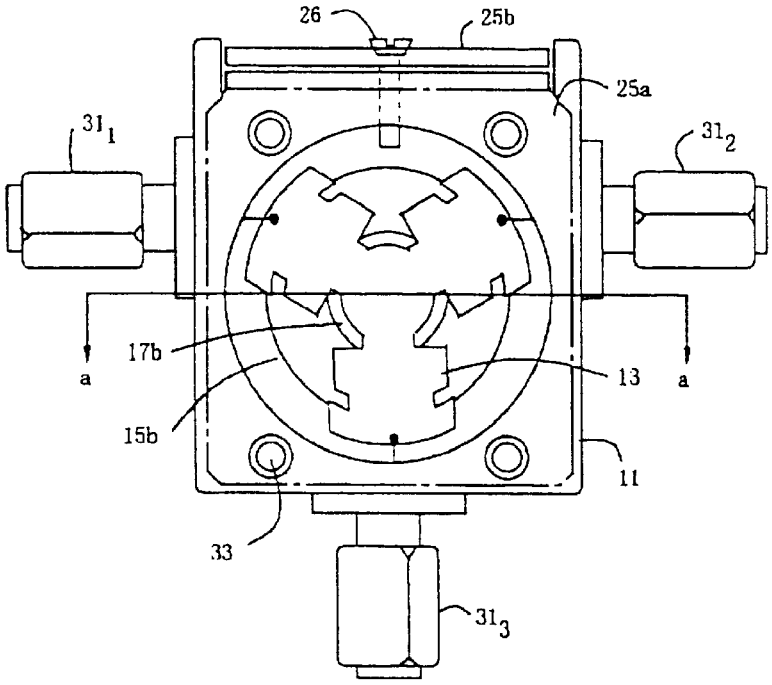
FIG. 17A PRIOR ART
FIGS. 17A and 17B are second diagrams illustrating the conventional art.
Figure 17B:
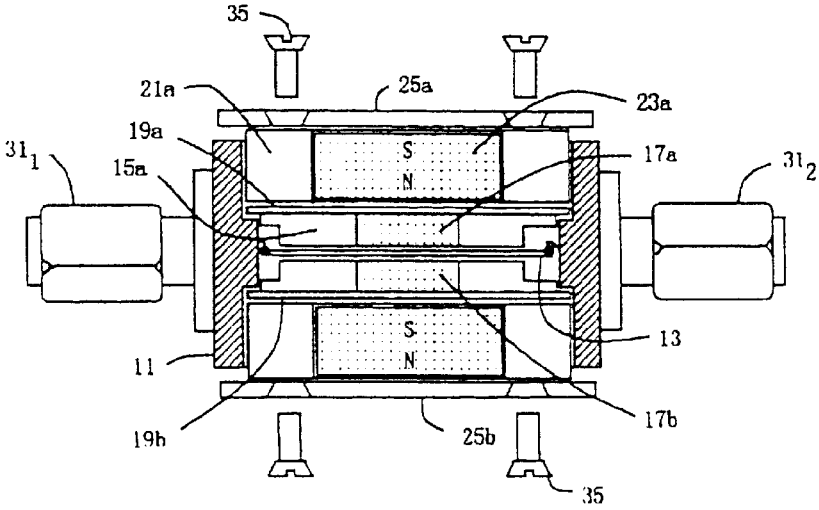
FIG. 17B PRIOR ART
Figure 18:
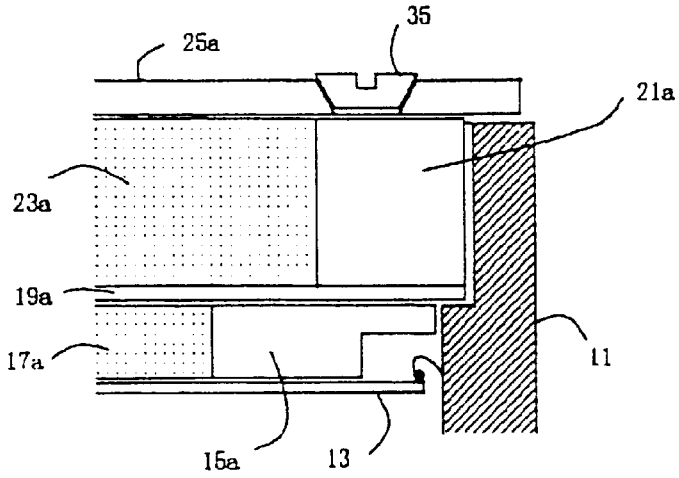
FIG. 18 PRIOR ART
FIG. 18 is a third diagram illustrating the conventional art.
Figure 19A:
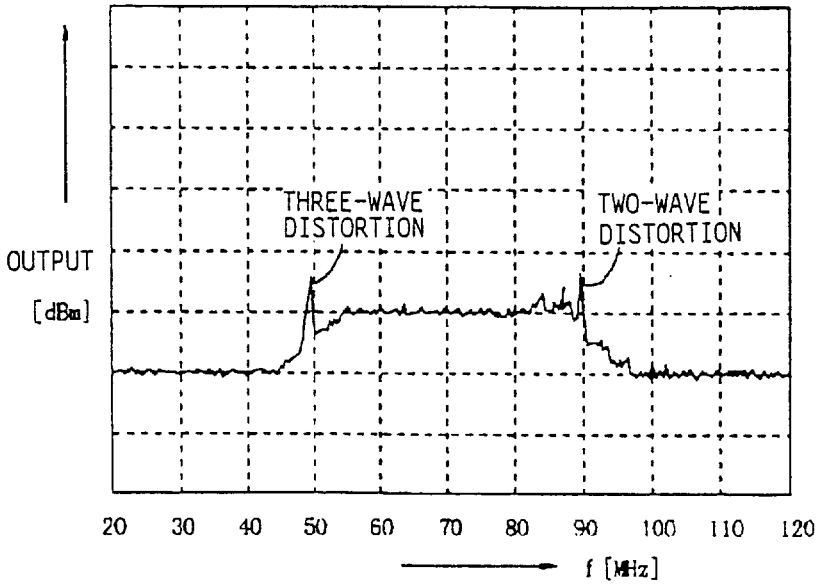
FIG. 19A PRIOR ART
FIGS. 19A and 19B are fourth diagrams illustrating the conventional art.
Figure 19B:
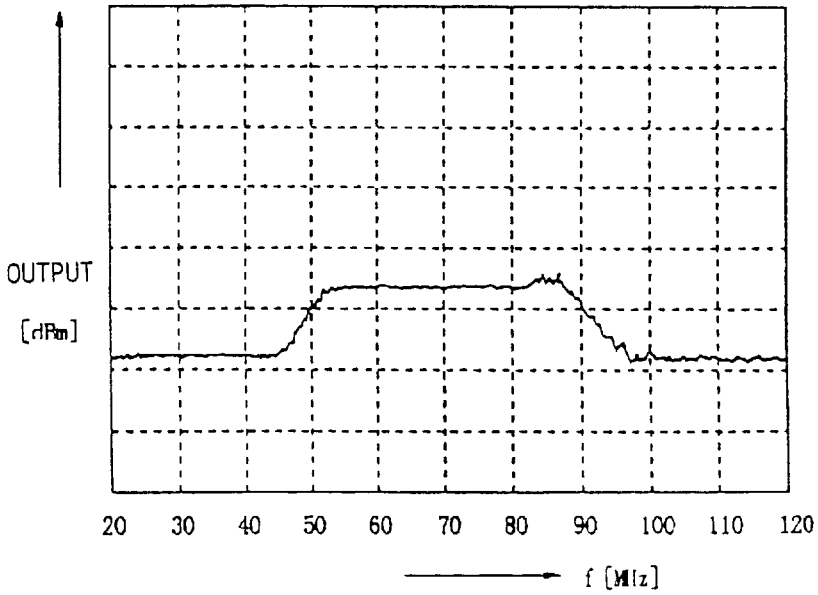
FIG. 19B PRIOR ART

FIGS. 14 and 15 are first and second diagrams of a device using coaxial circulators an element sharing device according to a third embodiment of the present invention, showing another and further structure by which a secure ground plane within a circulator waveguide space can be obtained. FIG. 14 shows an exploded or disassembled view of the coaxial circulator, with polytetrafluoroethylene support 15*b* inserted inside a countersunk hole 16*b* of the lower block 11*b.* The polytetrafluoroethylene support 15*b* extends in a height direction so as to encompass the functions of an upper polytetrafluoroethylene support 15*a,* so the need for such upper polytetrafluoroethylene support 15*a* is eliminated and hence the upper polytetrafluoroethylene support 15*a* is omitted. Into the polytetrafluoroethylene support 15*b* are inserted, in order, the ferrite member 17*b,* the Y-shaped conductive inner pattern 13 and the ferrite member 17*b*. Additionally, coaxial connectors $\mathbf{31}_1$, $\mathbf{31}_2$ and $\mathbf{31}_3$ mounted at side openings in each of three sides of a block 11*b,* the Y-shaped conductive inner pattern 13 being soldered between central conductors of each of the three coaxial connectors $\mathbf{31}_1$, $\mathbf{31}_2$ and $\mathbf{31}_3$. At this time a vertical notch portion provided on the polytetrafluoroethylene support 15*b* makes it easier to position the conductive inner pattern 13. A symmetrically shaped block 11*a* is then positioned atop the block 11*b* and the whole assembly tightened by screws. By so doing, a secure ground plane can be obtained within a waveguide space of the circulator. FIG. 15 shows a cross-sectional view of one such above-described fully assembled coaxial circulator.

The above description is provided in order to enable any person skilled in the art to make and use the invention and sets forth the best mode contemplated by the inventor of carrying out the invention.

The present invention is not limited to the specifically disclosed embodiments, and variations and modifications may be made without departing from the spirit and scope of the present invention.

The present application is based on Japanese Priority Application No. 11-212841, filed on Jul. 27, 1999, the entire contents of which are hereby incorporated by reference.

What is claimed is:

1. A coaxial circulator having ferrite members to which a static magnetic field is applied disposed at a junction of a Y-shaped strip conductor, the coaxial conductor comprising:

a dielectric substrate;

an inner pattern of the Y-shaped strip conductor provided on a center of an upper surface of the dielectric substrate; and ground patterns provided on the upper surface and a lower surface of the dielectric substrate along a periphery of the conductive inner pattern and electrically connected to each other via a plurality of through holes in the dielectric substrate, the substrate being sandwiched by an upper block and a lower block, the ferrite members being provided adjacent to both the upper side and a lower side of the substrate so as to ground the ground patterns to the upper and lower block surfaces, wherein the Y-shaped strip conductor and the ground patterns provided on the upper surface of the dielectric substrate lie in a common plane.

2. The coaxial circulator as claimed in claim 1, wherein the dielectric substrate has a multilayer structure and the inner pattern is provided on an intermediate layer thereof.

3. The coaxial circulator as claimed in claim 1, wherein a plurality of lands are provided at the periphery of the inner pattern.

4. The coaxial circulator as claimed in claim 1, further comprising a screw inserted from the upper block to a portion of the inner pattern where the inner pattern is connected to a coaxial connector.

5. The coaxial circulator as claimed in claim 1, wherein a low-pass filter pattern is formed on a connecting portion connecting the coaxial connector and the inner pattern.

6. A coaxial circulator having ferrite members to which a static magnetic field is applied disposed at a junction of a Y-shaped strip conductor, the coaxial conductor comprising:

a dielectric substrate having a plurality of layers;

an inner pattern of the Y-shaped strip conductor provided an inner layer of the dielectric substrate; and ground patterns provided on the inner layer and on outer layers of the dielectric substrate, along a periphery of the conductive inner pattern and electrically connected to each other via a plurality of through holes in the dielectric substrate, the substrate being sandwiched by an upper block and a lower block, the ferrite members being provided adjacent to both the upper side and a lower side of the substrate so as to ground the ground patterns to the upper and lower block surfaces, and wherein the Y-shaped strip conductor and the ground patterns provided on the inner layer of the dielectric substrate lie in a common plane.

* * * * *